US007987940B2

(12) United States Patent
Bryson et al.

(10) Patent No.: US 7,987,940 B2
(45) Date of Patent: Aug. 2, 2011

(54) HYDRAULIC ACCUMULATOR AND FIRE SUPPRESSION SYSTEM

(75) Inventors: James G. Bryson, Dexter, MI (US); Charles L. Gray, Jr., Pinckney, MI (US)

(73) Assignee: The United States of America as represented by the Administrator of the U.S. Environmental Protection Agency, Washington, DC (US)

( * ) Notice: Subject to any disclaimer, the term of this patent is extended or adjusted under 35 U.S.C. 154(b) by 238 days.

(21) Appl. No.: 12/384,789

(22) Filed: Apr. 9, 2009

(65) Prior Publication Data

US 2010/0258324 A1 Oct. 14, 2010

(51) Int. Cl.
*A62C 3/07* (2006.01)

(52) U.S. Cl. ..... 180/305; 180/306; 180/307; 180/308; 62/9; 62/20; 169/62

(58) Field of Classification Search ..... 180/65.21, 180/305–308; 62/9, 20; 169/62, 60, 56–57
See application file for complete search history.

(56) References Cited

U.S. PATENT DOCUMENTS

| | | | | |
|---|---|---|---|---|
| 4,248,309 | A * | 2/1981 | Hofle et al. | 169/47 |
| 5,515,691 | A * | 5/1996 | Wertenbach et al. | 62/133 |
| 5,908,074 | A * | 6/1999 | Potts | 169/60 |
| 5,934,379 | A * | 8/1999 | Østlyngen et al. | 169/46 |
| 6,164,383 | A * | 12/2000 | Thomas | 169/61 |
| 7,451,830 | B2 * | 11/2008 | Dierker, Jr. | 169/9 |
| 7,455,119 | B2 * | 11/2008 | Thompson | 169/9 |
| 7,597,153 | B2 * | 10/2009 | Thompson | 169/9 |
| 7,896,258 | B2 * | 3/2011 | Hoisington et al. | 239/155 |
| 2004/0226726 | A1 * | 11/2004 | Holland et al. | 169/62 |

* cited by examiner

*Primary Examiner* — J. Allen Shriver, II
*Assistant Examiner* — James Triggs
(74) *Attorney, Agent, or Firm* — David Read

(57) ABSTRACT

A hydraulic pressure accumulator has an interior chamber containing a fire-suppressing gas such as nitrogen. The fire-suppressing gas in the accumulator is fluidly connected to a thermal device, such as a valve with a thermal fuse or a controlled valve triggered by a thermal sensor. The thermal device is designed to open a fluid connection between the accumulator's interior chamber to ambient when the exterior temperature exceeds a determined safety threshold, thereby releasing the fire suppressing gas from the accumulator.

6 Claims, 5 Drawing Sheets

HYDRAULIC ACCUMULATOR AND FIRE SUPPRESSION SYSTEM

FIELD OF THE INVENTION

This invention relates to fire suppression systems, particularly for motor vehicles.

DESCRIPTION OF THE RELATED ART

U.S. Pat. Nos. 5,495,912 and 6,719,080, both to Gray, disclose hydraulic hybrid motor vehicles using hydraulic pressure accumulators as energy storage devices for the vehicles. U.S. Pat. No. 7,121,304 (Gray) and U.S. Pat. No. 7,108,016 (Moskalik and Gray), both incorporated by reference herein, disclose high and low pressure hydraulic accumulators suited for use in applications that include hydraulic hybrid motor vehicles.

Motor vehicle accidents, and other circumstances such as mechanical or electrical failures, can lead to fires occurring in a motor vehicle. Fires in motor vehicles of all kinds, including hydraulic hybrid motor vehicles, may create severe safety risks. Currently, around 12% of fire deaths in the United States involve motor vehicle fires.

Automatic sprinkler systems triggered by thermal fuses are known in the art of fire suppression systems.

SUMMARY OF THE INVENTION

An object of the present invention is to provide a fast and effective fire suppression means for motor vehicle fires, and particularly for hydraulic hybrid vehicles.

Another object of the present invention is to provide a fire suppression means for other industrial, civilian, or military applications where hydraulic pressure accumulators are needed or used for energy storage or other purposes.

DETAILED DESCRIPTION OF THE INVENTION

Figure 1:
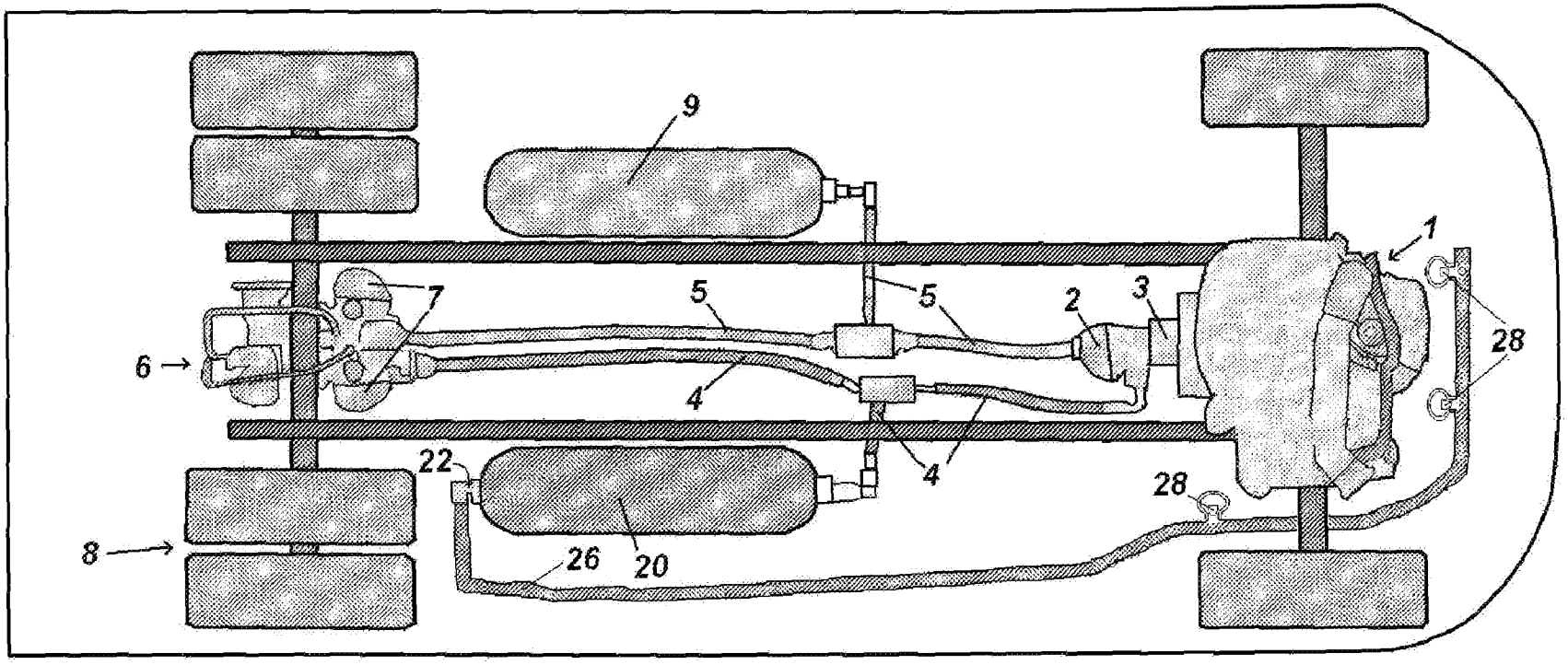
FIG. 1 presents a schematic view of a hydraulic hybrid motor vehicle with a fire suppression system according to one embodiment of the invention.

FIG. 1 presents a series hybrid powertrain for a motor vehicle, using a hydraulic energy storage system. An embodiment of this powertrain is more fully described in commonly-assigned U.S. Pat. No. 6,719,080 to Gray, which description is incorporated herein by reference. For purposes of this application, the arrangement of the hydraulic hybrid powertrain is not critical, and could instead use, for example, a parallel hydraulic hybrid powertrain such as is more fully set forth in U.S. Pat. No. 5,495,912, also to Gray.

Referring to FIG. 1, internal combustion engine 1 operates to drive a rotary engine pump/motor 2 as a hydraulic pump. Engine pump/motor 2 may be integrated onto the crankshaft (not shown) of engine 1, or connected thereto and driven by a driveshaft 3. In pump mode, pump/motor 2 receives low pressure hydraulic fluid from low pressure line 4 and pressurizes the fluid to a higher pressure. The higher pressure fluid then exits the pump through high pressure line 5. This high pressure fluid in line 5 may then be sent (a) to hydraulic drive assembly 6 to drive one or more hydraulic motors 7 to provide motive power to the vehicle drive wheels 8, or (b) to high pressure accumulator 9 for energy storage and later reuse, or (c) to both purposes.

Figure 2:
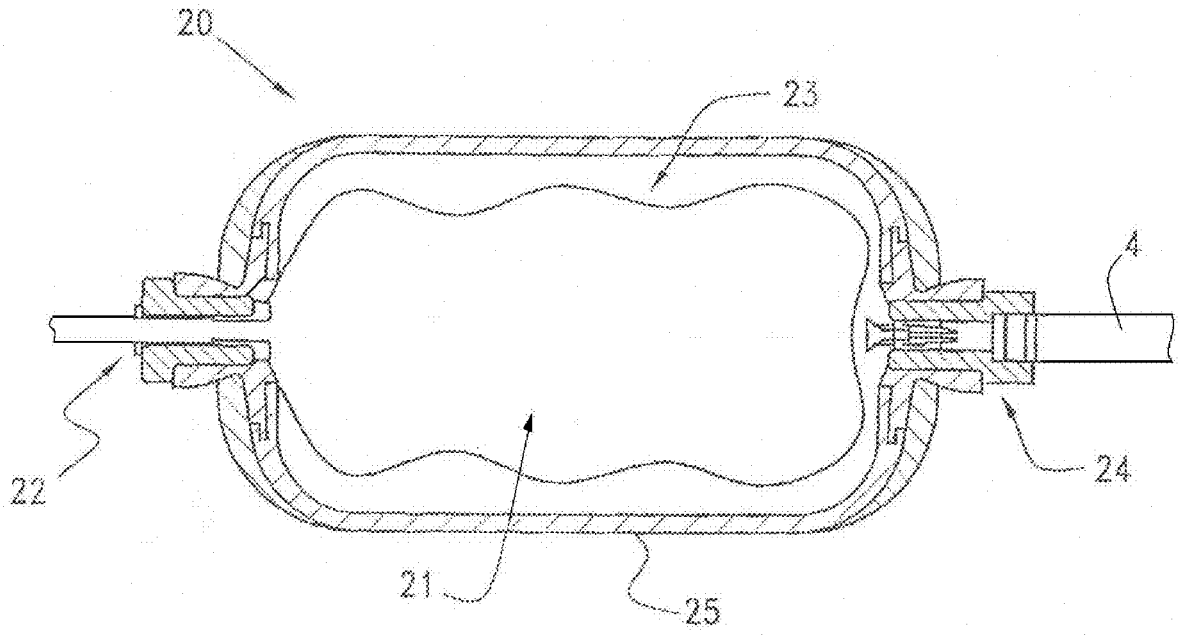
FIG. 2 presents a low pressure hydraulic accumulator.

Low pressure accumulator 20 serves as a fluid reservoir for the hydraulic energy storage system in FIG. 1. A bladder-type low pressure hydraulic accumulator 20 of known art is presented in greater detail in FIG. 2. A flexible bladder 21 contains a compressed inert gas, such as nitrogen. Other inert gases such as carbon dioxide could also be used. The inert gas is charged into bladder 21 through bladder fixture 22. Hydraulic fluid is contained in space 23, between housing 25 and bladder 21, and enters and exits accumulator 20 through fixture 24 to low pressure line 4.

Figure 3:
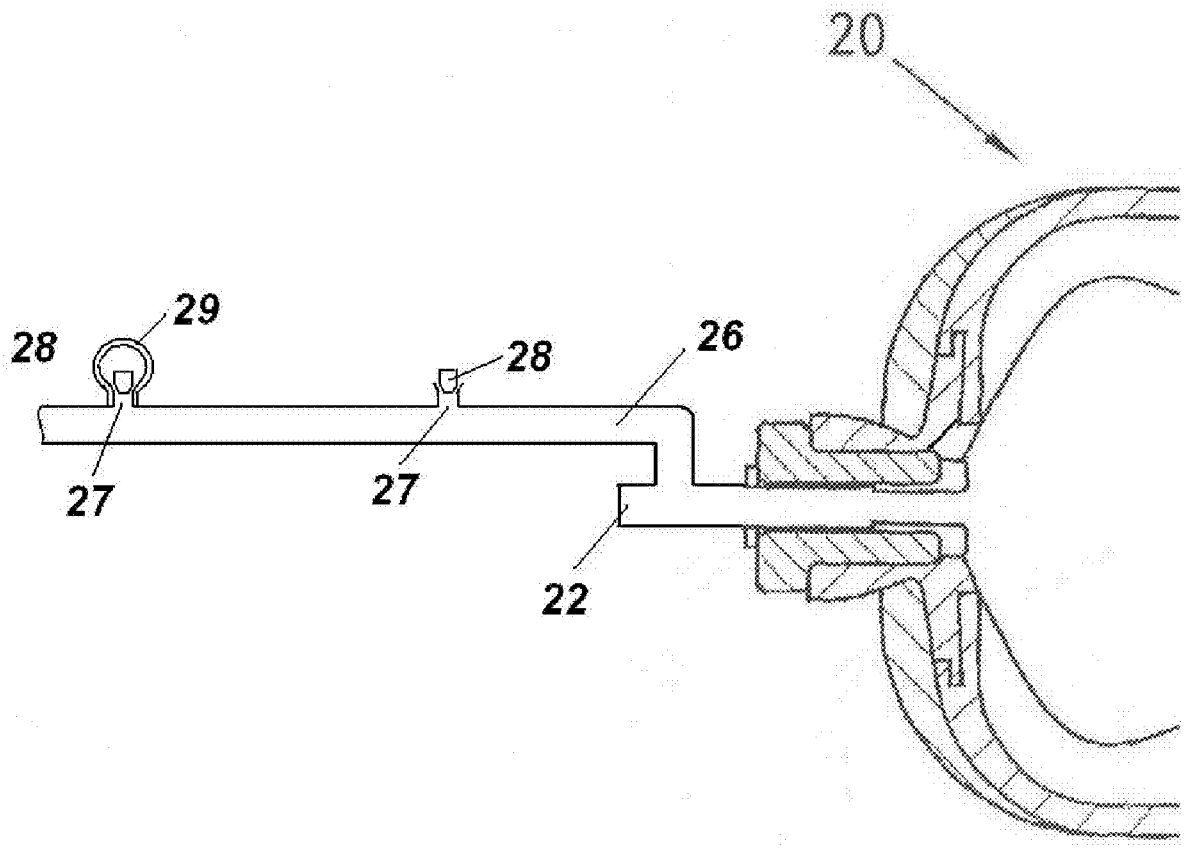
FIG. 3 presents a fire suppression system with thermal fuses fluidly connected to a low pressure hydraulic accumulator, according to one embodiment of the invention.

Referring now to FIG. 3, gas port 22 of low pressure accumulator 20 is fluidly connected to gas line 26. Low pressure gas line 26 contains one or more ports 27 which are capped or plugged by a thermal device 28. Thermal device 28 comprises a thermal fuse. While thermal device 28 is shown in the FIG. 3 as a meltable plug that fills orifice 27, it could also be in the form of a meltable cap that covers orifice 27, such as by screwing onto external threads around port 27. Thermal fuse 28 may optionally be retained in place by a protector/retainer 29. Thermal fuse 28 is preferably made of one of multiple possible metal alloys that abruptly melt at a particular temperature. Alternatively, thermal fuse 28 could be made of another material that melts or burns at a particular desired temperature. As another alternative for a thermal device, a non-melting cap or plug may be placed in proximity to a material that combusts and which is connected to a fuse to trigger combustion at a certain temperature, thus resulting in destruction of the cap/plug when the fuse is triggered. Any of these arrangements and their equivalents will be collectively termed a thermal device for purposes of this application. For a preferred embodiment in which the thermal fuse 28 melts, melting of the thermal fuse 28 at a determined temperature (e.g. a maximum safe level for the area, such as 300 or 400 degrees Fahrenheit) creates an orifice at port 27 that allows the inert gas within gas line 26 and bladder 21 to escape.

Thermal devices using metal alloys as discussed herein are commercially available, such as the T-Fuse™ pressure relief device available from Specialty & Ball Valve Engineering, Inc.

As shown in FIG. 1, orientation of the ports 27 may be such that when the thermal fuse 28 melts and allows the nitrogen gas to escape, the gas is directed to the most likely places where the fire-suppressing gas would be needed. In a motor vehicle, this would likely be the engine compartment, fuel tank and high pressure accumulator chamber. A sample arrangement is shown in FIG. 1. In other applications, the nitrogen or other fire-suppressing gas would preferably be directed to similar likely locations for fire, such as where hot machinery is found in close connection to leaks or other sources of flammable liquids or gases (such as gasoline, engine oil, transmission oil, or hydraulic oil). Preferably the fire-suppressing gases are not directed to enclosed occupied areas such as the passenger compartment of a car where it could potentially harm individuals by reducing oxygen concentrations below necessary breathing levels in such areas.

The fire suppression methods and devices herein apply to piston-in-sleeve, diaphragm, metal bellows, or other types of hydro-pneumatic hydraulic pressure accumulators in addition to bladder accumulators.

Figure 4:
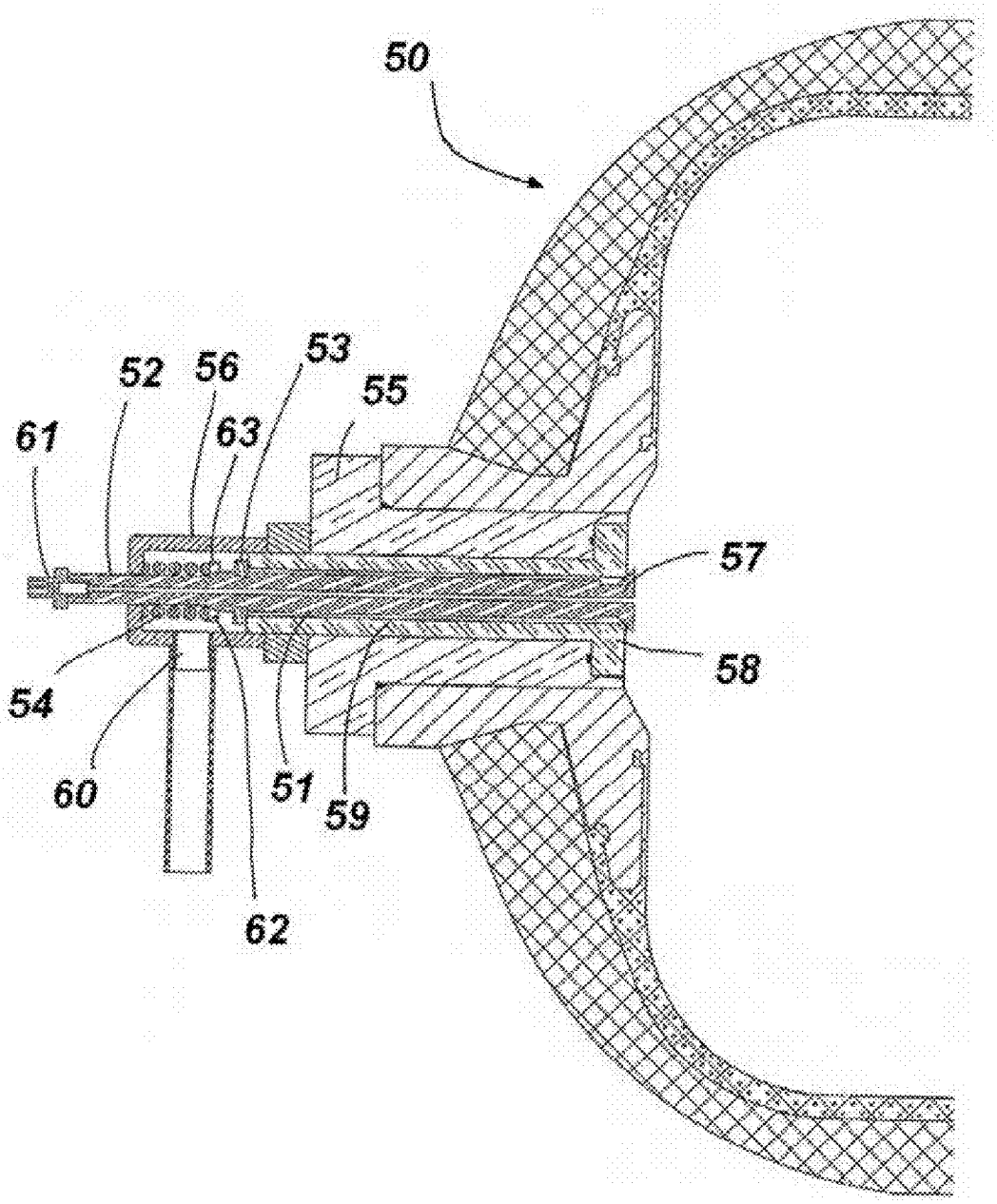
FIG. 4 presents a high pressure hydraulic accumulator with thermal fuse, according to another embodiment of the invention.

The fire suppression system could also be employed with a high pressure hydraulic accumulator. For example, with reference to FIG. 4, a thermal fuse could be located near, or incorporated into, a gas charge port/valve for a high pressure (or, alternatively, low pressure) hydraulic accumulator 50. One sample mechanism for the thermal fuse in this additional embodiment would be to position melting metal alloy restraints 53 to retain the gas port valve 57 in a closed position, with the restraints 53 serving to prevent spring 54 from pushing valve stem 52 and unseating/opening the valve 57. The restraints 53 further serve as a thermal fuse, with the restraints made from a selected metal alloy to melt at a desired activation temperature. When the thermal fuse restraints 53 melt, spring 54 pushes valve stem 52 to the right, thereby unseating valve 57 from surface 58, and thereby allowing discharge of gas from the accumulator through the annulus 51 between the valve stem 52 and gas port stem 59. One or more ports 62 may be positioned in shoulder 63 to allow discharge of the gas past the shoulder 63; alternatively, shoulder 63 does not need to extend all the way around the circumference of valve stem 52. The flow of gas allowed to escape the accumulator may be allowed to fill the accumulator compartment, or alternately be directed to previously selected and ported locations by means of discharge fitting/hose 60.

Retainer 56 is threaded into metal boss 55 and prevents spring 54 movement to the left in the drawing. A high pressure accumulator with a fire suppression system of this type could be used in conjunction with a low pressure accumulator with a fire suppression system (such as in FIGS. 1-3). For example, the high pressure accumulator and fire suppression system of FIG. 4 could be configured with a thermal fuse that melts at a higher temperature than the thermal fuse for the low pressure accumulator so as to only be triggered in the event that the low pressure accumulator fire suppression system is insufficient to stop a fire, or to only be triggered if fire threatens the high pressure accumulator compartment itself.

Figure 5:
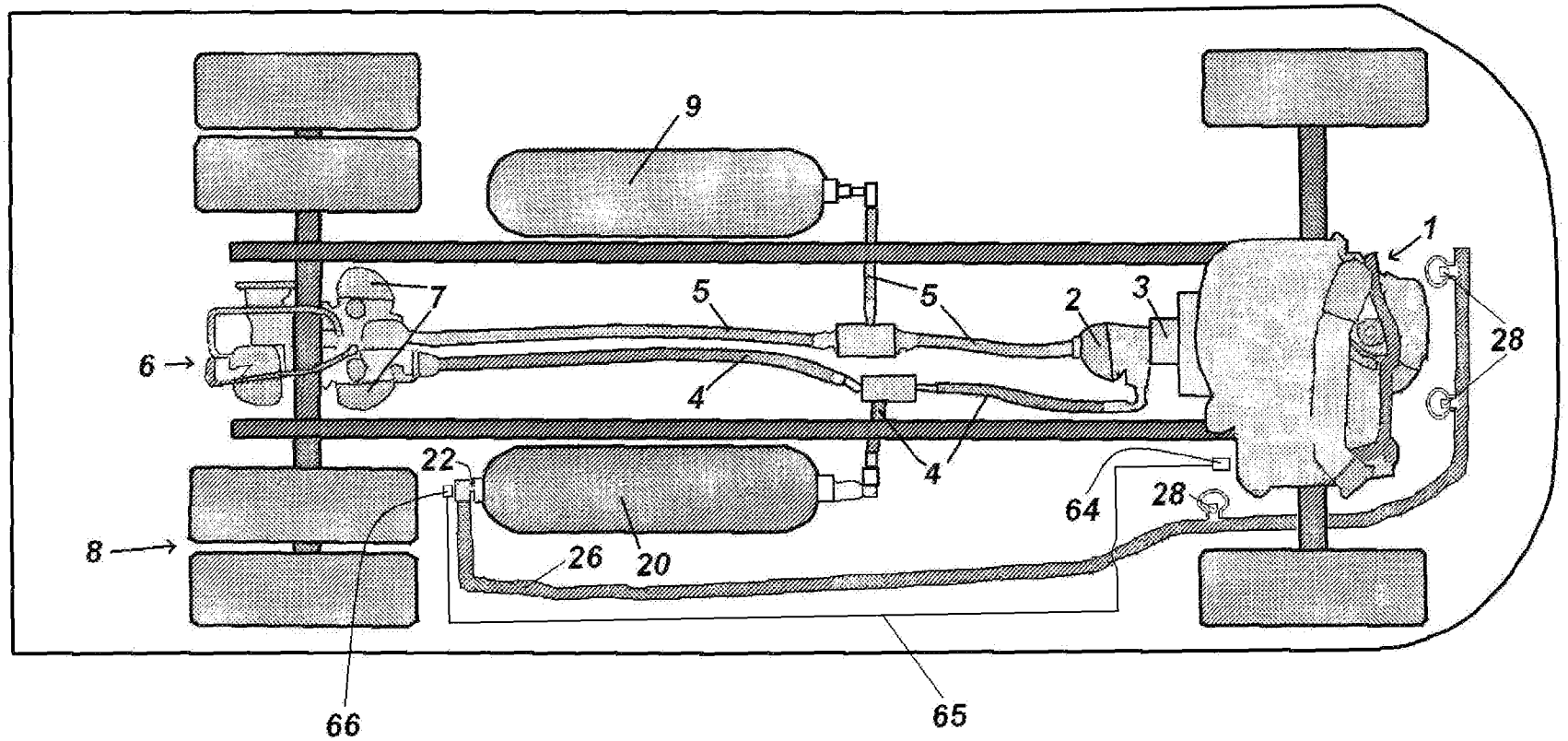
FIG. 5 presents a fire suppression system for a hydraulic hybrid motor vehicle, according to another embodiment of the invention.

In another embodiment, referring now to FIG. 5, the thermal device includes a temperature sensor 64 which may be located, for example, in the engine compartment. Upon sensing a predefined maximum temperature depending on the particular location of the sensor (e.g. 300 to 400 degrees Fahrenheit-near fuel devices) and receiving a signal (through electrical line 65, or wirelessly) generated by the temperature sensor, a small incendiary or other heating device 66 is configured to quickly heat and melt the fuse/plug in the accumulator. Appropriate incendiary or heating devices 66 could include a small combustion device such as are commercially used for airbag ignition and inflation; alternatively, a resistive heating wire could be used to melt the thermal fuse or plug. As another alternative, heating device 66 may be an electrically controlled valve that is triggered open based on temperature sensor 64 exceeding a predetermined threshold, e.g., 400 degrees Fahrenheit.

A controlled gas vent valve, orifice, or a pressure regulator may also be used to help control the release of the gas, if desired.

While particularly useful for hydraulic hybrid motor vehicle applications, it will also be understood that the device of the present invention may be used for other purposes as well, including, for example, industrial, military, and aviation applications that may use hydraulic pressure accumulators in the vicinity of heat-generating machines and flammable liquids such as oil.

From the foregoing it will also be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A hydraulic hybrid motor vehicle, comprising:

a vehicle frame;

drive wheels rotatably mounted on said vehicle frame;

a high pressure hydraulic pressure accumulator mounted on said vehicle frame, for storing energy in the form of pressurized and compressed fire-suppressing gas against a pressurized fluid;

a low pressure hydraulic pressure accumulator mounted on said vehicle frame, also storing pressurized and compressed fire-suppressing gas against a fluid, but at a pressure lower than in the high pressure hydraulic accumulator;

a hydraulic motor mounted on said vehicle frame, said hydraulic motor being driven at times by pressurized fluid from the high pressure accumulator to provide motive power for operation of the vehicle;

a thermal device, operating to prevent escape of pressurized and compressed fire-suppressing gas from the low pressure hydraulic pressure accumulator unless the temperature exceeds a determined level for safety, at which point the thermal device operates to allow fire-suppressing gas to escape from the low pressure hydraulic pressure accumulator.

2. The hydraulic hybrid vehicle of claim 1, wherein the thermal device comprises a thermal fuse configured to melt at a determined temperature, thereby opening a port for escape of the fire-suppressing gas.

3. The hydraulic hybrid vehicle of claim 2, wherein the thermal fuse comprises a metal alloy.

4. The hydraulic hybrid vehicle of claim 1, wherein the escaping fire-suppressing gas is directed toward likely locations for a fire in the vehicle.

5. The hydraulic hybrid vehicle of claim 1, wherein the thermal device comprises a temperature sensor and a controlled valve.

6. The hydraulic hybrid vehicle of claim 1, further comprising a hydraulic pump mounted on the vehicle frame, said hydraulic pump receiving fluid from the low pressure accumulator and pumping the fluid to a higher pressure for energy storage in the high pressure hydraulic pressure accumulator.

* * * * *